United States Patent [19]

Del Bon

[11] 4,195,748

[45] Apr. 1, 1980

[54] CLOSURE MEMBRANE

[76] Inventor: Franco Del Bon, 141, Fedlstrasse,, CH-4663 Aarburg, Switzerland

[21] Appl. No.: 11,577

[22] Filed: Feb. 12, 1979

[30] Foreign Application Priority Data

Feb. 15, 1978 [CH] Switzerland ..... 1645/78

[51] Int. Cl.[2] ..... B65D 51/22

[52] U.S. Cl. ..... 220/258; 220/260; 220/270; 220/359

[58] Field of Search ..... 220/258, 260, 270, 359; 229/7 R

[56] References Cited

U.S. PATENT DOCUMENTS 3,990,603 11/1976 Brochman ..... 220/260

4,088,242 5/1978 Schellenberg ..... 220/258

4,108,330 8/1978 Patterson ..... 220/270 X

*Primary Examiner*—George T. Hall

*Attorney, Agent, or Firm*—Edwin E. Greigg

[57] ABSTRACT

A closure membrane is described for closing a can opening which membrane comprises a flat part and a peripherally adjoining border zone destined to be hermetically sealingly connected to the can. In order to remove the flat part of the membrane safely and completely an opening is provided in the flat part of the membrane. This opening in the membrane is hermetically sealed by a piece of foil attached to the underside of the membrane and forming a tab element the bent back end of which projects out of the opening and forms the tab proper.

10 Claims, 4 Drawing Figures

FIG 1
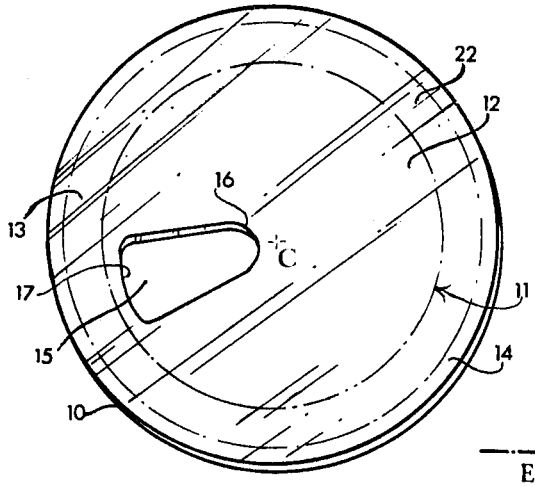
FIG. 2
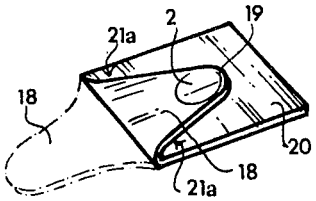
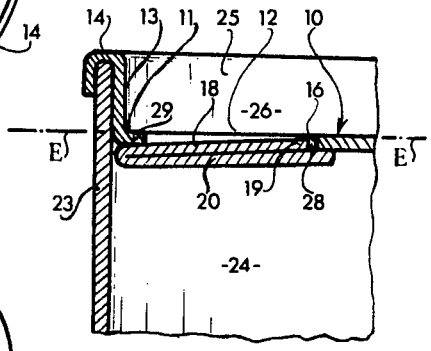
FIG. 3
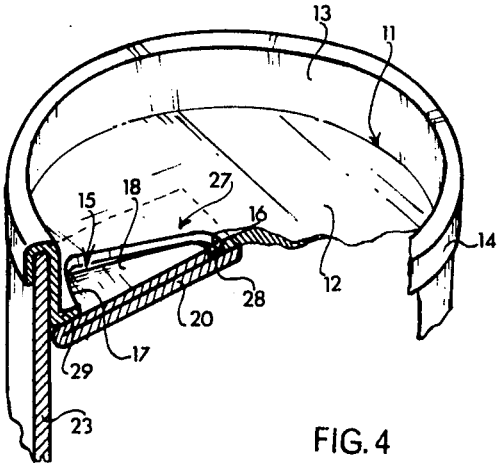
FIG. 4

CLOSURE MEMBRANE

BACKGROUND OF THE INVENTION

This invention relates to a closure membrane preferably made of laminated aluminum foil for closing the outlet opening of a can or the like container which closure membrane comprises a flat part destined to be hermetically sealingly connected with the can and a peripheral zone integral therewith.

A closure membrane of this type is described in U.S. Pat. No. 4,088,242 which issued on May 9, 1978 to Walter Schellenberg, Diepoldsau, Switzerland, the disclosure of which is hereby included by reference in the present application. This known closure membrane comprises a flat part (closure portion 16), a collar part (edge portion 8) and a tab (pull-off tab 18) and has the drawback that when the tab is lifted by the consumer to open the can it tends to form an irregular tear at an oblique angle relative to the periphery either inwardly into the root of the tab with resulting danger that the tab will be torn off and the membrane remain largely in place, or outwardly with the result that an irregular portion of the flat part and collar part of the membrane is torn out, leaving a major portion of the membrane in place still partly closing the can opening. This remaining portion of the membrane must then be removed with the aid of a finger or knife, or the like. Such irregular tearing of the membrane occurs especially when the tab is pulled with the finger at an angle to the periphery and not exactly radially thereto.

OBJECTS AND SUMMARY OF THE INVENTION

It is therefore an object of the invention to provide a closure membrane in which undesirable tearing-off of the kind described above does not occur and which can be made in a simple manner with a minimum of material, and wherein a pull-off tab provided in the membrane is easily distinguished from the rest of the membrane.

The object is attained in a closure membrane of the initially described type according to the invention wherein an opening is provided in the flat part of the membrane which opening is closed by a preferably rectangular-shaped tab element comprising a tab and a base part preferably made integral of aluminum foil and attached to the underside of the membrane and wherein the tab projects out of the opening in the closure membrane; when the tab and base part are integral this is achieved by bending the free tab end of the tab element back over the base part. Thus, the tab element can be provided in a simple and material saving manner.

The tab element carrying the tab on one of its free ends is connected in a simple manner, preferably by glueing or heat-sealing, to the underside of the flat part of the closure membrane and forms a safe hermetical seal therewith.

The pull-tab itself can have the form of a tongue and especially approximately the form of an isosceles triangle with a rounded tip, wherein the base of the triangle is constituted by the transition zone in which the tab is bent away from the flat base part underneath the closure membrane and through the opening in the latter. The lateral edges of the tab merge with the edges of the flat base part in the aforesaid transition zone and preferably have an inwardly curved parabolic configuration up to the said transition zone.

The outer face of the closure membrane destined to face away from the container interior can have the color of aluminum or silver, the inner face can be another color, e.g. red, when the membrane has an inward external layer of sealing material such as a sealing laquer or scaling wax.

The part of the tab element forming the pull tab can also be colored so that e.g. a red underside appears after bending the free tab end in the opening of the e.g. silver-colored flat part of the closure membrane, and is thus easily distinguishable therefrom.

The opening in the flat part of the closure membrane is preferably made by cutting and can be shaped to have approximately the form of an isosceles triangle with rounded edges whereof the triangle base extends along the peripheral zone adjoining the flat part of the closure membrane and the rounded tip of the triangle points towards the center of the said flat part of the closure membrane.

The tab element carrying the pull-tab on its free end is preferably connected to the closure membrane by gluing or sealing-on, and the tab proper is bent back and rests on the base part of the tab element, and the three protruding sides of the base part are connected with the edge zone about the opening on the underside of the flat part of the closure membrane.

The remaining folded side of the tab element is double-layered and when this side is connected to the said edge zone of the opening in the flat part of the closure membrane a double-glueing or sealing-on connection is achieved and three layers of material thus overlap each other.

This has the great advantage of optimally anchoring the tab, on the one hand, so that the tab is protected from being torn-off alone as can happen when pulling known tabs. Moreover, the three-layer connection provides an important strengthening of the closure membrane in the zone where a maximum upwardly directed tensile stress acts when the tab is pulled at an acute angle relative to the plane defined by the flat part of the closure membrane in order to take off the latter and open the container and the opening stress is transmitted to the desired opening zone about the flat part of the closure membrane which zone is preferably formed by providing a preferably circular-shaped groove in the closure membrane where its flat part contacts the can wall.

Thus the whole zone on which opening stress acts can be optimally reinforced according the the invention as described above.

A further advantage of the invention is that the pull-tab can be easily seized. By choosing differently colored material the tab is clearly distinguishable from the rest of the closure membrane and a separate sheet of instructions for taking off the closure membrane and opening the can becomes superfluous.

Preferably laminated aluminum foil or foil made of a synthetic plastics material can be used as material for the closure membrane and the tab element.

DESCRIPTION OF THE DRAWING

The invention is now described in more detail with reference to the drawing wherein:

FIG. 1 is a top view, at an angle slightly deviating from the perpendicular, of the unbent blank for the closure membrane according to the invention already containing the opening, FIG. 2 is a perspective view of the tab element according to the invention wherein the tab is bent back over the base part and the unbent tab is shown by phantom lines, FIG. 3 is a cross-sectional view of part of a can with its lid removed closed by a closure membrane shown in FIG. 1 with the tab element shown in FIG. 2 fixed thereto according to the invention, FIG. 4 is a perspective view of a partially opened can, closure membrane and tab element in the configuration shown in FIG. 3.

DETAILED DESCRIPTION OF THE EMBODIMENTS SHOWN IN THE DRAWING

The blank of closure membrane 10 consists of a circular-shaped disk of appropriate material, e.g. laminated aluminum foil, having a weakened zone concentrically about disk center C in the form of a groove 11. Closure membrane 10 can preferably have a wall thickness of 0.03 mm in the groove-free portion, whereas the thickness in the groove 11 can be approximately only 0.02 mm. Groove 11 surrounds a circular area which constitutes flat part 12 of closure membrane 10 after deep-drawing (cupping). After deep-drawing, flat part 12 is peripherally surrounded by an upwardly directed collar part 13 which carries at its upper end an annular flange part 14 destined to be crimped over the can wall.

In the region of membrane 10 destined to become flat part 12 an opening 15 is provided which has approximately the form of an isosceles triangle with rounded tip 16 which latter points toward disk center C. The (triangle) base 17 of opening 15 is preferably situated parallel and at a small distance (compared to the radius of the disk) from groove 11.

The pull-tab 18 is integral with rectangular shaped base part 20 of the tab element shown in FIG. 2; it is bent back over base part 20 and has a shape corresponding to the shape of opening 16; but it is somewhat smaller in dimension so that it can be freely inserted into opening 15 when the tab element is fixed to the underside of flat part 12.

The lateral edges 21*a* of tab 18 merge with edges of the flat base part in a transition zone and preferably have an inwardly curved parabolic configuration up to the said transition zone, which afford excellent conditions for welding or glueing. A gripping hole 21 can be cut in the free end part of the tab 18 near tip 19.

Gripping hole 21 serves to prevent a sliding of the finger tips and has optical advantages when the upper face of the base part is differently colored. After bending of tab 18, the preferably red color of the upper face of the base part 20 of the tab element can be seen through gripping hole 21 making possible a quick recognition of tab 18 and an immediate understanding of the whole opening process.

The edge zone of closure membrane 10 forming the upwardly directed collar part 13 which latter outwardly adjoins groove 11 is destined to be connected in a hermetically sealing manner with the circumferential can wall 23 of a can 24 which can wall projects upwardly out of the plane E defined by the flat part 12 of the closure membrane 10 after insertion in can 24.

Annular flange part 14 of the inserted membrane 10 is crimped over circumferential wall 23 of can 24. In the recess 26 made by deep drawing in the closure membrane 10 which serves as a warranty seal, a lid (not shown) is placed in a manner known per se.

It is shown in FIG. 4 how base part 20 of the tab element comes to lie with its edges beneath the peripheral zone 27 of opening 15 and is sealingly connected thereto. Due to the fact that tip 19 of tab 18 is not made so long as to extend up to the edge of opening 15 (at 16) a gap 28 remains between tip 19 and the said edge of opening 15 and facilitates lifting of the tab 18.

The tab element comes to lie with its bent transition zone beneath part 29 of peripheral zone 27, thus forming a three-layer reinforcement, whereby, when pull-tab 18 is pulled, the resulting tensile stress acts upon reinforced part 29, prevents a tearing of tab 18 and makes possible a clean and easy removal of the tab element with the attached flat part of closure membrane 10.

Due to the advantageous arrangement of pull-tab 18, the latter can be easily gripped with the fingers of the actuating hand and pulled in an upward direction. A tear forms along a part of groove 11 adjacent the reinforced part 29 and by further pulling of tab 18 upwards and outwards, the flat part 12 of closure membrane 10 is torn off from collar part 13 along groove 11 and can be taken out of can opening 25. The tearing off along groove 11 is clean, i.e., without leaving pieces of flat part 12 joined with collar part 13 and jutting into the open can interior, as can easily occur in the case of known closure membranes.

I claim:

1. A closure membrane for closing a can opening and having an upper and a lower face, which membrane comprises a flat part having an opening therein, a peripherally adjoining border zone thereof destined to be hermetically sealingly connected with a can, and a tab element comprising a pull-tab and a base part, said tab being bent back relative to said base part, said base part of said tab element being sealingly attached to said lower face with said bent-back tab projecting out of said opening, whereby said base part closes said opening in said flat part hermetically.

2. The closure membrane of claim 1, wherein said pull-tab is tongue-shaped and has approximately the form of an isosceles triangle with rounded tip and said base part is joined to the base of said triangle.

3. The closure membrane of claim 2, wherein the lateral edges of said tab merge with the edges of said base part in a transition zone.

4. The closure membrane of claim 3, wherein the lateral edges of said tab have an inwardly curved parabolic configuration extending from said transition zone toward said tip.

5. The closure membrane of claim 1, wherein said pull-tab has a grip hole.

6. The closure membrane of claim 1, wherein said opening in said flat part of said membrane has approximately the shape of an isosceles triangle with rounded tip.

7. The closure membrane of claim 6, wherein the side of said opening which constitutes the base of said isosceles triangle extends adjacent said border zone of said membrane.

8. The closure membrane of claim 7, wherein said rounded tip of said opening is directed towards the center of said flat part of said membrane.

9. The closure membrane of claim 3, wherein the base part and the folded back pull-tab of said tab element together with the portion of the flat part of said membrane above the said transition zone form together a triple layer of material in the region of attachment of said tab element to said flat part of said membrane.

10. The closure membrane of claim 3, wherein the tip of said tab and the next adjacent edge of said opening in said flat part of said membrane leave a gap therebetween.

* * * * *